US008540500B1

(12) United States Patent
Balkus, Jr.

(10) Patent No.: US 8,540,500 B1
(45) Date of Patent: Sep. 24, 2013

(54) HIGH CAPACITY LIGHTWEIGHT COMPACT VANE MOTOR OR PUMP SYSTEM

(76) Inventor: Carl E. Balkus, Jr., Happy Camp, CA (US)

( * ) Notice: Subject to any disclaimer, the term of this patent is extended or adjusted under 35 U.S.C. 154(b) by 0 days.

(21) Appl. No.: 13/466,432

(22) Filed: May 8, 2012

(51) Int. Cl.

| | |
|---|---|
| ***F01C 1/344*** | (2006.01) |
| ***F01C 21/04*** | (2006.01) |
| ***F04C 2/344*** | (2006.01) |
| ***F04C 18/344*** | (2006.01) |
| ***F04C 29/02*** | (2006.01) |

(52) U.S. Cl.
USPC ..... 418/260; 418/264; 418/83; 418/178

(58) Field of Classification Search
USPC ..... 418/260, 264, 83, 178
See application file for complete search history.

(56) References Cited

U.S. PATENT DOCUMENTS

| | | | | | |
|---|---|---|---|---|---|
| 167,367 | A | * | 8/1875 | Vandemark | 418/264 |
| 394,242 | A | * | 12/1888 | Byers | 418/264 |
| 2,636,480 | A | * | 4/1953 | Becker | 418/260 |
| 3,001,482 | A | * | 9/1961 | Osborn | 418/264 |
| 3,250,223 | A | * | 5/1966 | Krawacki | 418/28 |
| 3,598,510 | A | | 8/1971 | Aoki | |
| 3,973,881 | A | | 8/1976 | Melchinger | |
| 3,988,083 | A | | 10/1976 | Shimizu | |
| 4,230,088 | A | * | 10/1980 | Southard | 418/83 |
| 4,386,891 | A | | 6/1983 | Riefel | |
| 4,799,867 | A | * | 1/1989 | Sakamaki et al. | 418/178 |
| 4,818,196 | A | | 4/1989 | Kahrs | |
| 4,859,163 | A | | 8/1989 | Schuller | |
| 5,030,074 | A | | 7/1991 | Sakamaki | |
| 5,551,853 | A | | 9/1996 | Cherry | |
| 6,203,303 | B1 | | 3/2001 | Fujiwara | |
| 6,877,969 | B2 | | 4/2005 | Yao | |
| 2009/0087334 | A1 | * | 4/2009 | Whitesell | 418/178 |
| 2009/0223480 | A1 | * | 9/2009 | Sleiman et al. | 123/243 |

* cited by examiner

*Primary Examiner* — Mary A Davis
(74) *Attorney, Agent, or Firm* — Neustel Law Office

(57) ABSTRACT

A high capacity lightweight compact vane motor or pump system which utilizes vanes with extensions to improve efficiency of the system overall. The present invention generally includes a rotor housing, a rotor, a housing cover. The rotor housing will generally include a central opening in which the rotor is positioned. The rotor will generally include a plurality of radially spaced vane slots. A rotor vane will generally be positioned within each vane slot. Each rotor vane will generally include a first extension and a second extension, wherein the first extension extends into slidable engagement with a groove on the housing cover and the second extension extends into slidable engagement with a groove on the interior surface of the rotor housing. As the rotor is rotated within the housing, the vanes will slide into and out of the slots to create voids to hold oil to be expelled at the outlet.

18 Claims, 6 Drawing Sheets

HIGH CAPACITY LIGHTWEIGHT COMPACT VANE MOTOR OR PUMP SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a new and useful hydraulic pump or motor with a cam-shaped housing and controlled vane configuration and more specifically it relates to a wide high capacity lightweight compact vane motor or pump system which utilizes vanes with extensions which are guided by grooves within the rotor housing cover adapted to limit break-in wear and a novel oil circulation system to improve efficiency of the system overall.

2. Description of the Related Art

Any discussion of the related art throughout the specification should in no way be considered as an admission that such related art is widely known or forms part of common general knowledge in the field.

Rotary vane pumps and motors have been in use for years in various applications, such as hydraulic pumps, transmission pumps, compressors and the like. Conventional heavy construction rotary vane pumps are generally comprised of a rotor positioned within an additional cam and ring. The rotor is generally rotatably secured within the housing through use of a shaft. Rotor vanes are positioned radially around the rotor, which slide in and out by centrifugal force utilizing springs and cams as the rotor rotates within the housing.

While there are a number of different rotary vane pump configurations currently available, existing designs will often be less efficient in operation as the rotary units are heavy and/or large with a small output for some applications.

Because of the inherent problems with the related art, there is a need for a new and improved high capacity lightweight compact vane motor or pump system which utilizes wider vanes with extensions and wear members which are guided by grooves within the rotor cap and housing and with additional pressure relieving oil passages, improving efficiency of the system overall.

BRIEF SUMMARY OF THE INVENTION

The invention generally relates to a rotary vane system which includes a rotor housing having a cam-shaped interior, a rotor, a housing cover and internal rear shaft. The rotor housing will generally include a central opening in which the rotor is positioned and internal rear shaft. The rotor will generally include a plurality of radially spaced vane slots. A rotor vane will generally be positioned within each vane slot. Each rotor vane will generally include a first extension and a second extension, wherein the first extension extends into slidable engagement with a cam-shaped groove on the housing cover and the second extension extends into slidable engagement with a cam-shaped groove on the interior surface of the rotor housing. The rotor will have a galley under each vane, a groove connecting galleys at each end and apertures connecting to an inner groove inside the central rotor shaft hole. The undersides of each vane will have equal pressure as the pressure of the pump, getting pressure through a notch in the cover connected to the pump exit and to the cam groove, to rotor end grooves connecting galleys under the vanes. These galleys afford a free flow of oil from vane to vane through the end grooves of the rotor, as well as through apertures connecting galleys to machined grooves in the rotor shaft hole, thus allowing unrestricted oil flow from under wide vanes. As the rotor is rotated within the housing, the vanes will slide into and out of the slots to create voids to hold oil to be expelled at the outlet.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
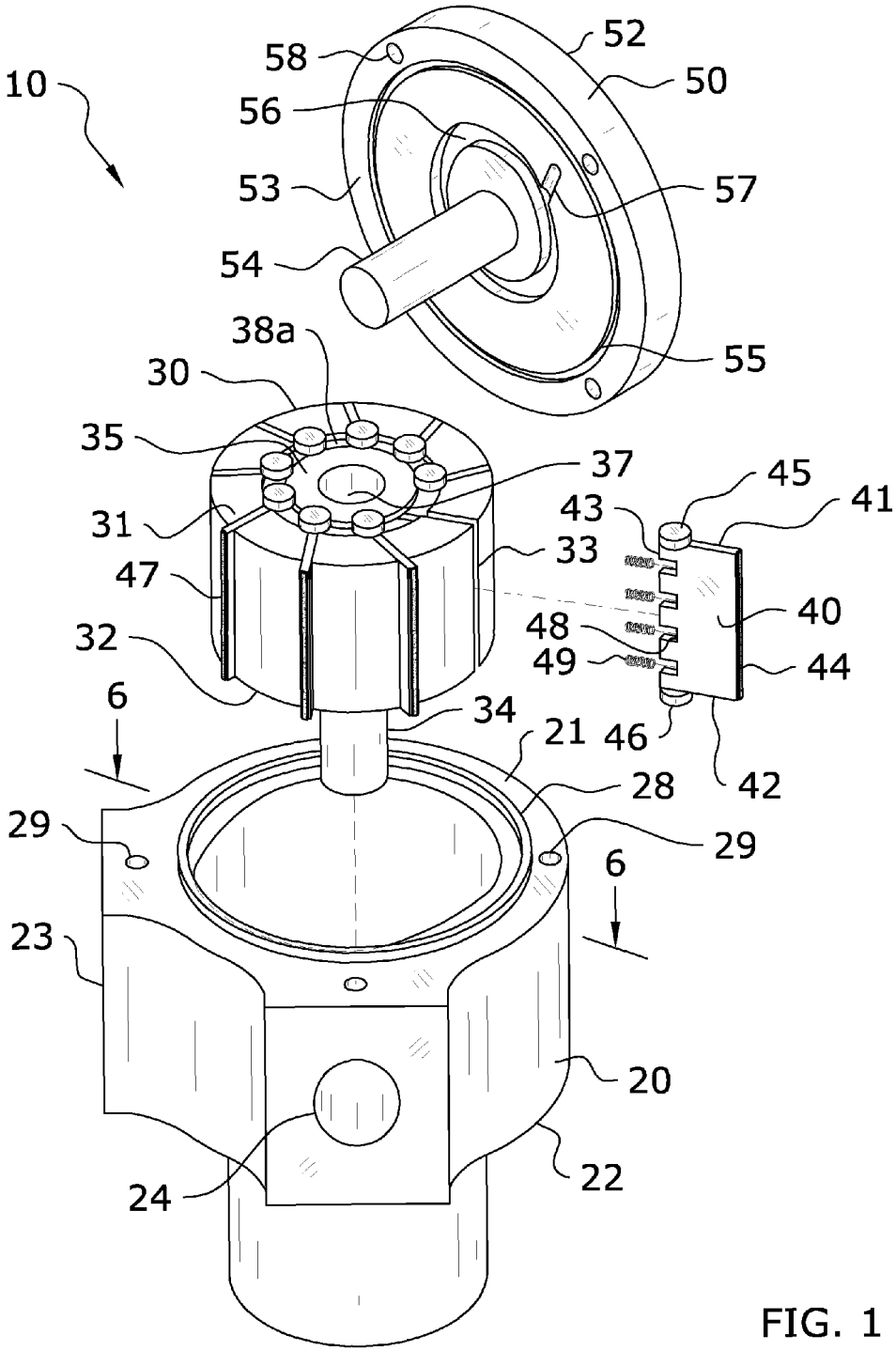
FIG. 1 is an upper perspective view of the present invention illustrating its various components in an unassembled state.

Turning now descriptively to the drawings, in which similar reference characters denote similar elements throughout the several views, FIGS. 1 through 6 illustrate a high capacity lightweight compact vane motor or pump system 10, which comprises a rotor housing 20, a rotor 30, and a housing cover 50. The rotor housing 20 will generally include a central opening 25 in which the rotor 30 is positioned. The rotor 30 will generally include a plurality of radially spaced, angled vane slots 33. A rotor vane 40 will generally be positioned within each vane slot 33. Each rotor vane 40 will generally include a first extension 45 and a second extension 46, wherein the first extension 45 extends into slidable engagement with a groove 56 on the housing cover 50 and the second extension 46 extends into slidable engagement with a groove 27 on the interior surface 26 of the rotor housing 20. The outer end 44 of each rotor vane 40 will also generally include a wear member 47 and the inner end 43 of each rotor vane 40 will include a plurality of slots 48 for accommodating bias members 49. As the rotor 30 is rotated within the housing 20, the vanes 40 will slide into and out of the slots 33, thus causing voids at the intake 23 to fill and move oil by rotation to the outlet 24.

B. Rotor Housing

The present invention will generally include a rotor housing 20 as shown in FIG. 1. The rotor housing 20 may be comprised of various configurations and structures, and should not be construed as being limited to the particular configuration shown in the figures. In a preferred embodiment, the rotor housing 20 interior will be cam-shaped as shown in the figures.

The rotor housing 20 will generally include an upper end 21, a lower end 22, an inlet 23, an outlet 24 and a central opening 25. A central opening 25 will generally be positioned within the upper end 21 of the rotor housing 20. The central opening 25 will generally be comprised of a circular opening through which the rotor 30 of the present invention will be positioned into the rotor housing 20.

The inlet 23 and outlet 24 will each generally be positioned on the radial outer surface of the rotor housing 20, wherein a fluid such as oil or hydraulic fluid will enter through the inlet 23 and exit through the outlet 24. The positioning and configuration of the inlet 23 and outlet 24 may vary for different applications, and thus the configuration should not be limited to that which is shown in the figures.

Figure 2:
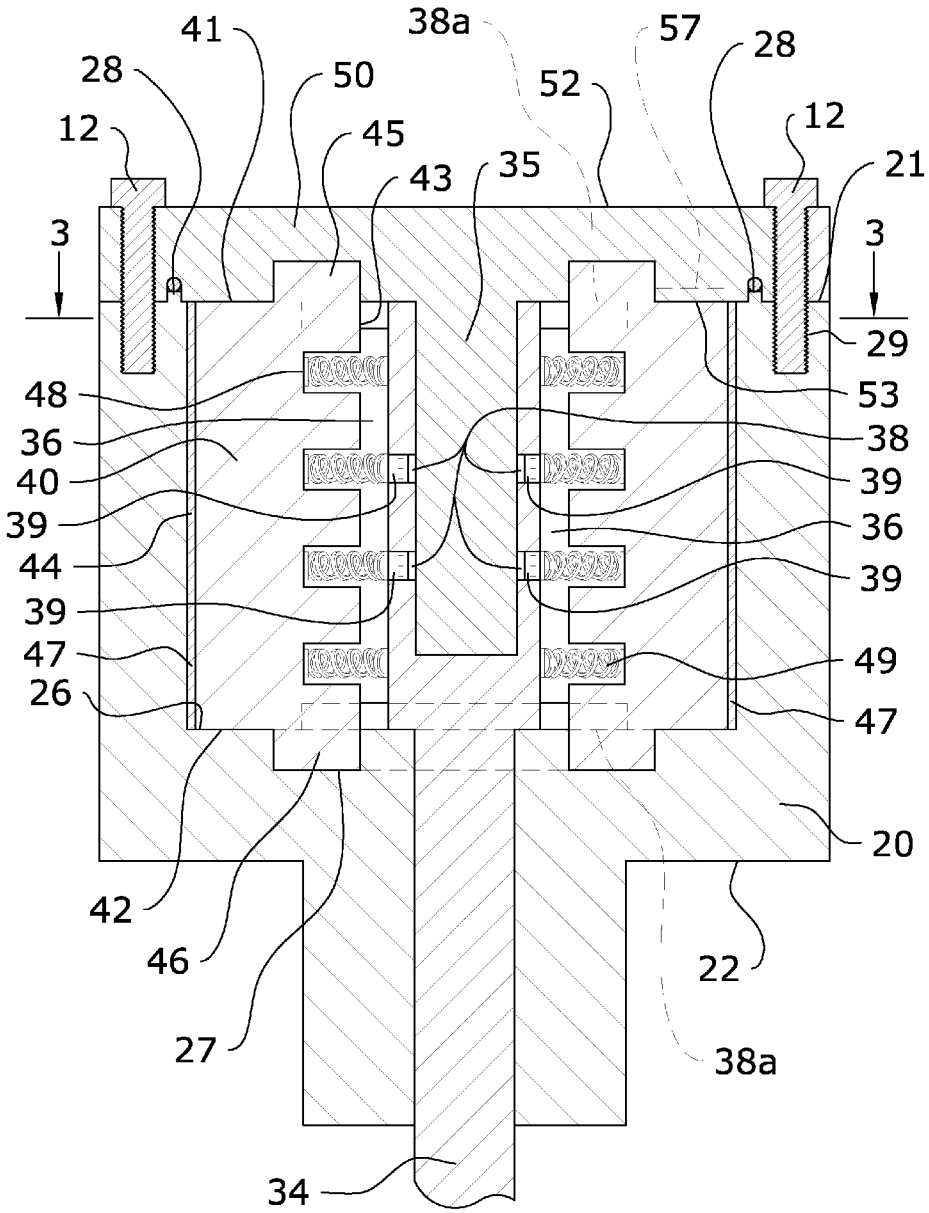
FIG. 2 is a side sectional view of the present invention in an assembled state.

The rotor housing 20 will generally include an interior surface 26 positioned at the bottom of the central opening 25 as shown in FIG. 2. The lower end 32 of the rotor 30 will generally rest on the interior surface 26 of the rotor housing 20 when positioned within the central opening 25.

A groove 27 will generally be positioned within the interior surface 26 of the rotor housing 20 for guiding and supporting the second extensions 46 of the rotor vanes 40 as shown in FIG. 2. The groove 27 will generally be positioned concentrically with respect to the shaft 34 of the rotor 30 when it is positioned within the central opening 25. The groove 27 will generally match the shape of the inner groove 56 of the housing cover 50, so that both the groove 27 of the rotor housing 20 and the inner groove 56 of the housing cover 50 act to guide the rotor vanes 40 as they rotate within the housing 20. As such, the groove 27 of the rotor housing 20 and the groove 56 of the housing cover 50 will each preferably be comprised of a cam shape.

The rotor housing 20 will also generally include an O-ring and tang 28 extending around its upper end 21 as shown in FIG. 2. The tang 28 will generally be circular in shape and match the shape and positioning of the outer groove 55 of the housing cover 50 with O-ring to create a seal between the cover 50 and the housing 20.

The rotor housing 20 will also generally include at least one aperture 29 on its upper end 21 through which a fastener 12 such as a bolt may be extended to secure the housing cover 50 to the rotor housing 20 as shown in FIG. 2.

C. Rotor

The present invention will generally include a rotor 30 which is rotatably positioned within the rotor housing 20. The rotor 30 is generally comprised of a cylindrical shape and includes an upper end 31 and a lower 32 as shown in FIG. 1.

A central shaft 34 will generally extend downwardly from the lower end 32 of the rotor 30. The upper end of the rotor 30 will generally include a bore hole 37 which extends downwardly from the upper end 31 of the rotor 30 as shown in FIG. 1. A bearing 35 will also be positioned within the bore hole 37 as it extends through the rotor 30 body to allow rotation of the rotor 30 within the rotor housing 20 as shown in FIGS. 1 and 2. A machined groove 38 is created on the inner circumference of the bore hole 37 through which oil will pass when the present invention is in use before oiling the bearing 35. It is appreciated that, in some embodiments, multiple machined grooves 38 may be positioned vertically offset from each other to improve the circulation of oil between vane slots as shown in the figures.

Figure 3:
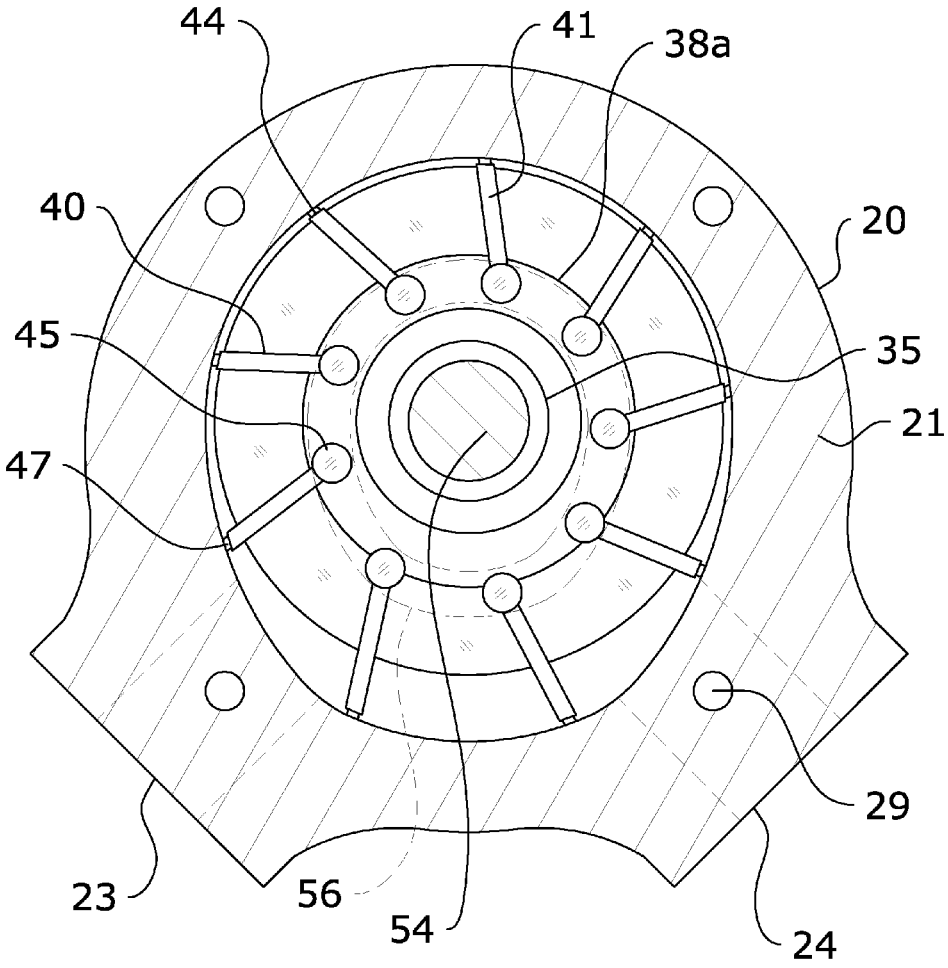
FIG. 3 is a top sectional view of the present invention.
Figure 4:
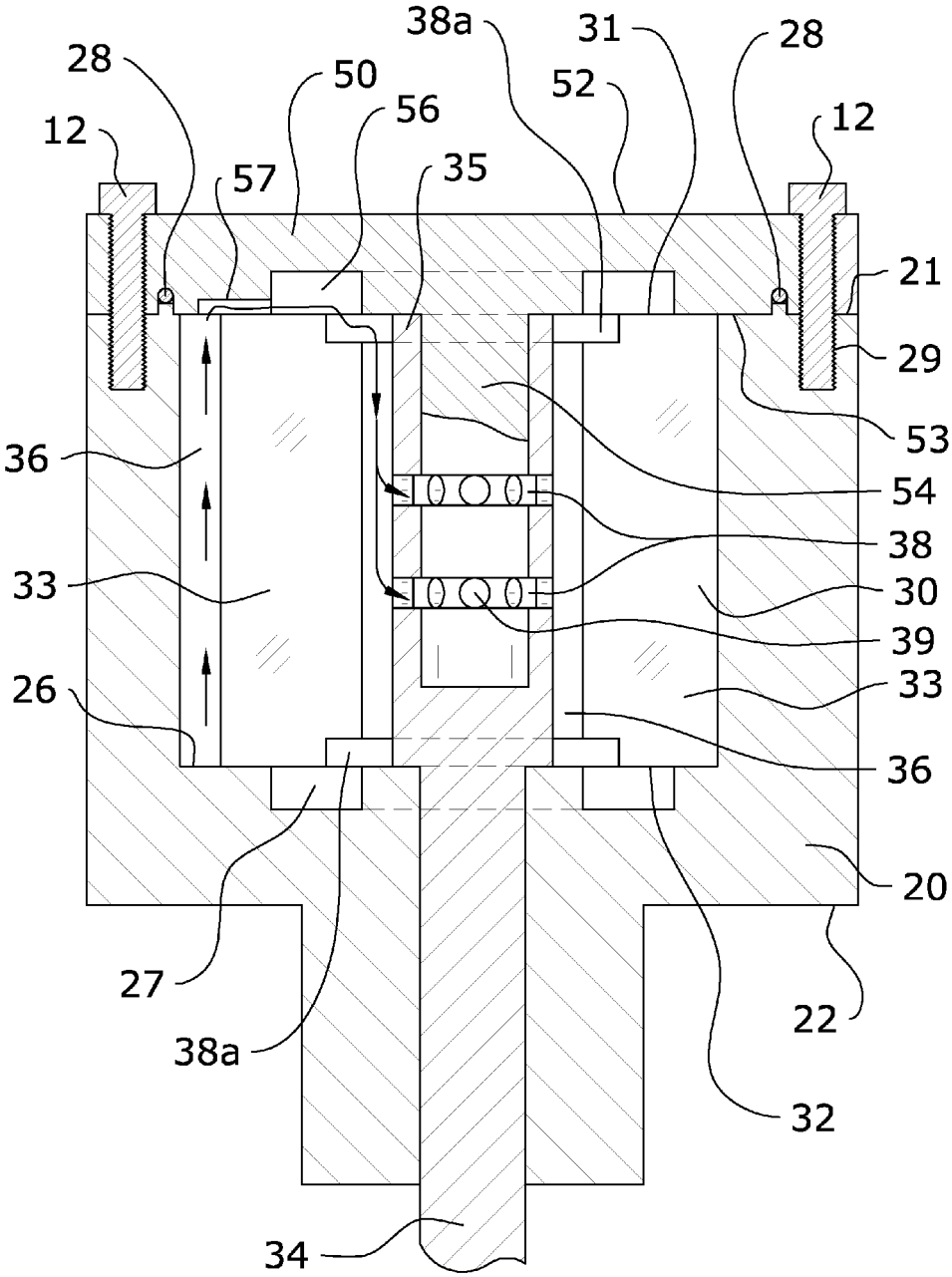
FIG. 4 is a sectional view of the present invention illustrating the internal path of oil while the present invention is in use.
Figure 5:
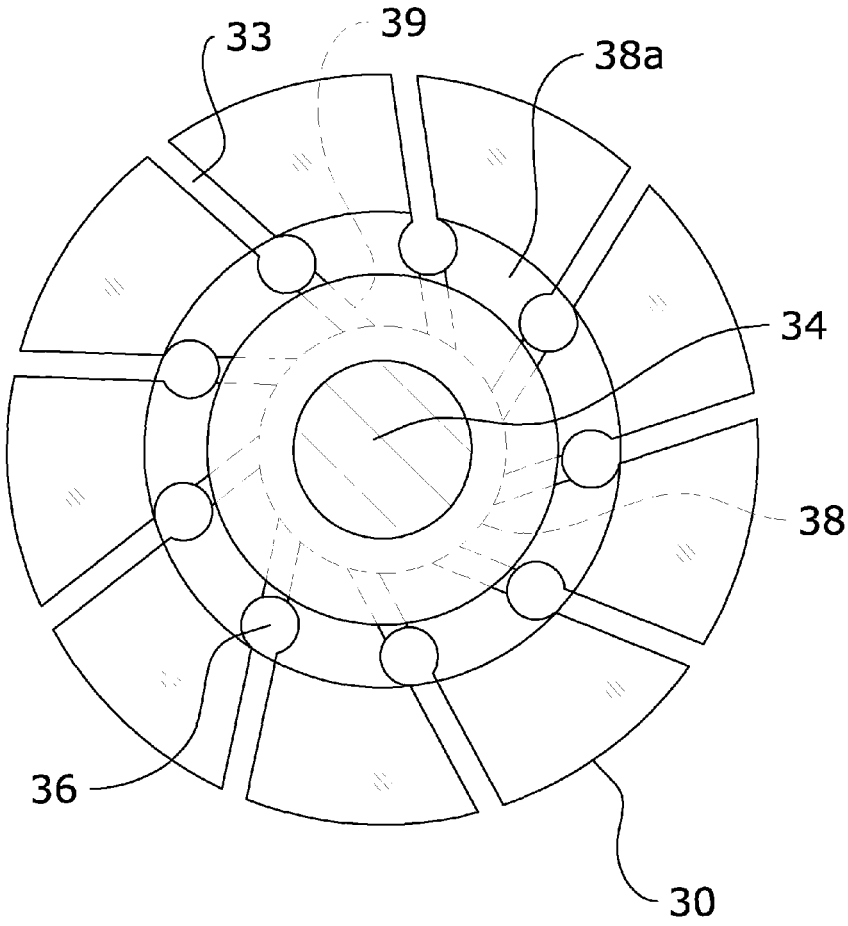
FIG. 5 is a top view of the rotor of the present invention.
Figure 6:
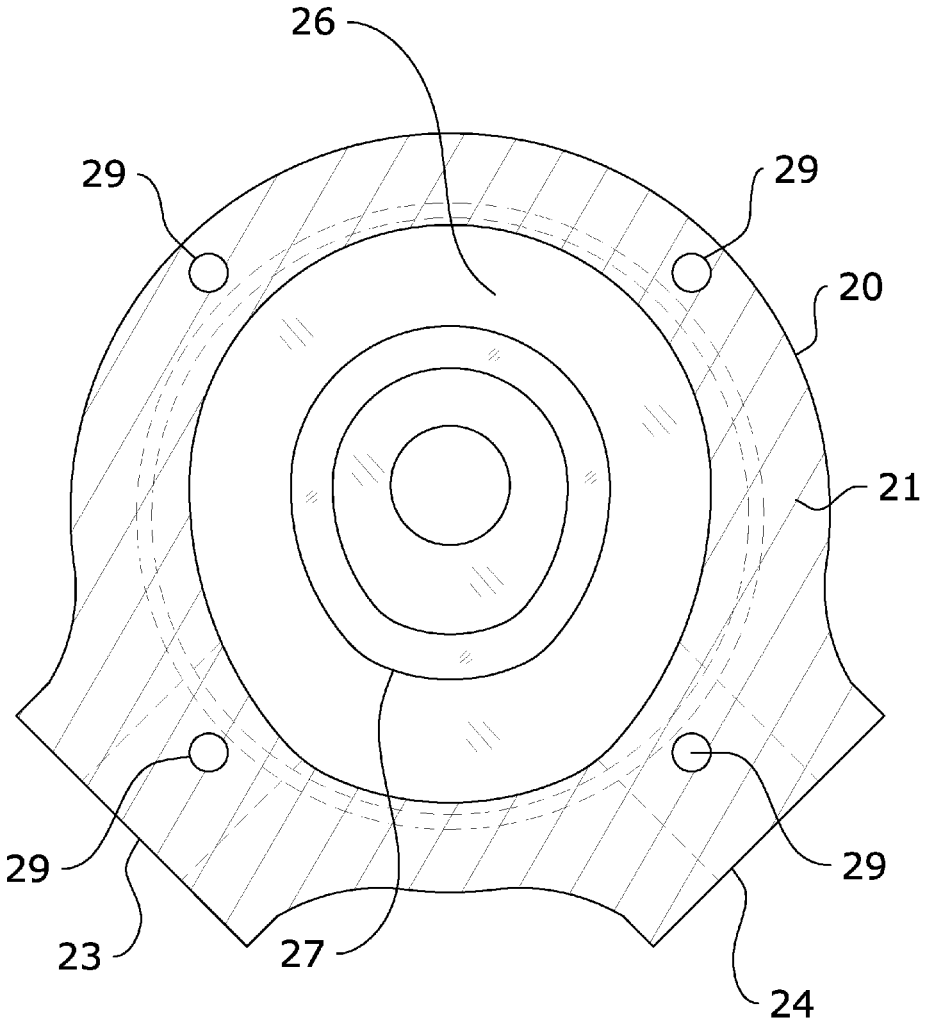
FIG. 6 is a top sectional view of the rotor housing of the present invention.

The rotor 30 will also generally include a plurality of rotor vane slots 33, each of which are positioned radially around the central shaft 34 as shown in FIG. 3. Preferably, each of the rotor vane slots 33 will be angled toward the pressure port of the pump or motor as shown in FIGS. 3-5. The vane slots 33 will generally be slightly offset; slanting diagonally from the central shaft 34 to the radial outer circumference of the rotor 30 as shown in FIG. 3. Each of the rotor vanes 40 of the present invention will generally be positioned within a corresponding vane slot 33.

It is appreciated that the number and positioning of the vane slots 33 within the rotor 30 which are shown in the figures is merely for illustrative purposes only. Thus, the number and positioning of vane slots 33 should not be construed as being limited to that which is shown in the figures; more or less vane slots 33 may be utilized for different applications.

The rotor 30 will also include an oil galley 36 connecting grooves 38A at each end, as shown as shown in FIGS. 4-5. The oil galleys 36 are comprised of pathways or open spaces adjacent the inner end 43 of each rotor vane 40. The present invention will also include end rotor grooves 38A as shown in FIGS. 4-5. A first end rotor groove 38A will extend around the inner circumference of the upper end 31 of the rotor 30 and a second end rotor groove 38A will extend around the inner circumference of the lower end 32 of the rotor 30. Oil will pass through the end rotor grooves 38A and through the oil galleys 36 before entering the machined grooves 38 through a plurality of apertures 39 which are aligned and fluidly connected with the machined grooves 38 as shown in FIG. 4.

D. Rotor Vane

As shown in FIG. 1, the present invention will generally include a plurality of rotor vanes 40. Each rotor vane 40 will generally be comprised of a substantially rectangular member having an upper end 41, lower end 42, an inner end 43 and an outer end 44 which is positionable within a corresponding vane slot 33 within the rotor 30.

The inner end 43 of each rotor vane 40 will generally include a plurality of slots 48 into which bias members 49 may be positioned to allow the rotor vanes 40 to slide in and out of the vane slots 33 when the present invention is in use. In a preferred embodiment, the bias members 49 will be comprised of springs. The numbering and positioning of the slots 48 on the inner end 43 of the rotor vanes 40 may vary for different applications.

The outer end 44 of each rotor vane 40 will generally include a wear member 47 which is preferably comprised of a wearable material as shown in FIG. 1. The wear member 47 is utilized to allow a faster break-in of the rotor vanes 40 and to improve the pressure seal when used with the present invention. The vane extensions 45, 46 may include a holdback on the vanes 40 to halt further wear on the wear members 47 after break in.

Each rotor vane 40 will generally include a first extension 45 and a second extension 46 as shown in FIG. 1. The extensions 45, 46 will preferably be comprised of a circular outer circumference. The first extension 45 will generally extend upwardly from the upper end 41 of the rotor vane 40 from a position adjacent its inner end 43 such that the first extension 45 slides within the inner groove 56 of the housing cover 50 when the present invention is in use. The second extension 46 will generally extend downwardly from lower end 42 of the rotor vane 40 from a position adjacent its inner end 43 such that the second extension 46 slides within the groove 27 of the interior surface 26 of the rotor housing 20 when the present invention is in use. Through use of the extensions 45, 46 and grooves 55, 56, the sliding motion of the rotor vanes 40 may be more efficiently and accurately controlled than with conventional rotor designs.

E. Housing Cover

The present invention will generally include a housing cover 50, which is utilized to close off and seal the upper end 21 of the rotor housing 20. The housing cover 50 will generally be comprised of a substantially circular configuration having an upper end 52 and a lower end 53 as shown in FIG. 1.

The lower end 53 of the housing cover 50 will generally include an outer groove 55 and an inner groove 56. The outer groove 55 will generally be circularly shaped in a manner which matingly engages with the tang 28 and O-ring on the upper end 21 of the rotor housing 20 so as to create a seal between the housing cover 50 and the rotor housing 20. The inner groove 56 will generally be comprised of a cam shape in which the first extensions 45 of the rotor vanes 40 will be slidably positioned and guided when the present invention is in use.

The lower end 53 of the housing cover 50 also includes a shaft 54 extending downward therefrom as shown in FIG. 1. The shaft 54 matingly engages with the bore hole 37 and bearing 35 of the present invention such that the rotor 30 of the present invention rotates around the shaft 54 when the present invention is in use.

The lower end 53 of the housing cover 50 will also generally include a notch 57 formed therein that may be in communication with the higher pressure port of the motor or pump. The notch 57 may be positioned at various locations on the lower end 53 of the housing cover 50 and may be comprised of various shapes. Thus, the exemplary structure and location of the notch 57 may vary for different applications. The notch 57 starts oil pressure to the shaft 54 and additionally adds oil pressure equal to exit pressure of the present invention 10 through the cover cam groove 56, rotor end groove 38A and circulation under the rotor vanes 40 by connecting all galleys 36 by drill holes 39 into the groove 38, ultimately equalizing under vane and inter-vane oil pressure as shown in FIG. 4.

The housing cover 50 may also include one or more apertures 48 extending from its upper end 52 to its lower end 53 which are aligned with corresponding apertures 29 on the upper end 21 of the rotor housing 20. Fasteners 12 may be positioned through the apertures 48, 29 to secure the housing cover 50 to the rotor housing 20.

F. Operation of Preferred Embodiment

In use, the rotor 30 is rotated within the rotor housing 20. The rotor vanes 40 will be guided in a cam-type path by the grooves 27, 56 so that they slide in and out of the vane slots 33 within the rotor 30 to create voids that fill at the intake 23 and are expelled at the outlet 24 of the present invention. Fluid such as hydraulic fluid or oil will be pulled into the inlet 23 of the rotor 30 and expelled out of outlet 24 of the rotor housing 20 through the action of the rotor vanes 40. FIG. 4 illustrates the inner path of the oil as it circulates through the present invention from the notch 57 to the inner cam-shaped groove 56, through the oil groove 38A, oil galleys 36, apertures 39 to groove 38 and to bearing 35.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A high capacity lightweight compact vane motor or pump system, comprising:

a rotor housing, wherein said rotor housing includes an interior surface, wherein said interior surface includes a groove, wherein said rotor housing includes an inlet and an outlet;

a rotor positionable within said rotor housing, wherein said rotor includes a plurality of vane slots, wherein said rotor includes a bore hole, a bearing and a machined groove extending around an interior of said bore hole;

a plurality of rotor vanes, wherein each of said rotor vanes are positioned within each of said plurality of vane slots, wherein each of said rotor vanes includes a first extension and a second extension, wherein each of said first extensions are slidably positioned within said groove of said interior surface of said rotor housing, wherein said rotor includes at least one galley positioned adjacent an inner end of each of said rotor vanes and further comprising a plurality of apertures linking said at least one galley with said machined groove; and a housing cover, wherein said housing cover includes an upper end and a lower end, wherein said lower end of said housing cover includes an inner groove, wherein each of said second extensions are slidably positioned within said inner groove.

2. The high capacity lightweight compact vane motor or pump system of claim 1, wherein each of said plurality of rotor vanes includes a wear member positioned at an outer end thereof.

3. The high capacity lightweight compact vane motor or pump system of claim 2, wherein said wear member is comprised of a wearable material.

4. The high capacity lightweight compact vane motor or pump system of claim 1, wherein each of said plurality of rotor vanes includes an upper end and a lower end, wherein said first extension extends upwardly from said upper end of each of said plurality of rotor vanes.

5. The high capacity lightweight compact vane motor or pump system of claim 4, wherein said second extension extends downwardly from said lower end of each of said plurality of rotor vanes.

6. The high capacity lightweight compact vane motor or pump system of claim 5, wherein each of said plurality of rotor vanes includes an inner end and an outer end, wherein said first extension is positioned adjacent said inner end of each of said plurality of rotor vanes.

7. The high capacity lightweight compact vane motor or pump system of claim 1, wherein said housing cover includes a notch, wherein said notch is fluidly connected with said inner groove of said housing cover.

8. A high capacity lightweight compact vane motor or pump system, comprising:

a rotor housing, wherein said rotor housing includes an interior surface, wherein said interior surface includes a groove, wherein said rotor housing includes an upper end and a lower end, wherein said rotor housing includes an inlet and an outlet;

a central shaft extending from said lower end of said rotor housing;

a tang and O-ring positioned on said upper end of said rotor housing, wherein said tang is concentric with respect to said central shaft;

a rotor positionable within said rotor housing, wherein said rotor includes a first end groove at its upper end and a second end groove at its lower end, wherein said rotor includes a plurality of vane slots, wherein each of said plurality of vane slots is angled, wherein said rotor includes a bore hole, wherein said rotor includes a plurality of galleys, wherein said rotor includes a bearing;

a machined groove positioned within said bore hole, wherein said plurality of galleys are fluidly connected to said machined groove;

a plurality of rotor vanes, wherein each of said rotor vanes are positioned within each of said plurality of vane slots, wherein each of said rotor vanes includes a first extension and a second extension, wherein each of said first extensions are slidably positioned within said groove of said interior surface of said rotor housing;

a housing cover, wherein said housing cover includes an upper end and a lower end, wherein said lower end of said housing cover includes an inner groove and an outer groove, wherein each of said second extensions are slidably positioned within said inner groove, wherein said tang is sealably engaged with said outer groove, wherein said inner groove is comprised of a cam shape;

a notch formed on said lower end of said housing cover, wherein said notch is fluidly connected with said inner groove; and a shaft extending from said housing cover, wherein said shaft is adapted to be inserted within said bore hole.

9. The high capacity lightweight compact vane motor or pump system of claim 8, wherein each of said plurality of rotor vanes includes a wear member positioned at an outer end thereof.

10. The high capacity lightweight compact vane motor or pump system of claim 9, wherein said wear member is comprised of a wearable material.

11. The high capacity lightweight compact vane motor or pump system of claim 8, wherein each of said plurality of rotor vanes includes an upper end and a lower end, wherein said first extension extends upwardly from said upper end of each of said plurality of rotor vanes.

12. The high capacity lightweight compact vane motor or pump system of claim 11, wherein said second extension extends downwardly from said lower end of each of said plurality of rotor vanes.

13. The high capacity lightweight compact vane motor or pump system of claim 12, wherein each of said plurality of rotor vanes includes an inner end and an outer end, wherein said first extension is positioned adjacent said inner end of each of said plurality of rotor vanes.

14. The high capacity lightweight compact vane motor or pump system of claim 13, wherein said second extension is positioned adjacent said inner end of each of said plurality of rotor vanes.

15. The high capacity lightweight compact vane motor or pump system of claim 8, wherein said machined groove extends around an interior of said bore hole.

16. The high capacity lightweight compact vane motor or pump system of claim 15, wherein said plurality of galleys are positioned adjacent an inner end of each of said rotor vanes.

17. The high capacity lightweight compact vane motor or pump system of claim 16, further comprising a plurality of apertures linking said plurality of galleys with said machined groove.

18. A high capacity lightweight compact vane motor or pump system, comprising:

a rotor housing, wherein said rotor housing includes an interior surface, wherein said interior surface includes a groove, wherein said rotor housing includes an upper end and a lower end, wherein said rotor housing includes an inlet and an outlet;

a central shaft extending from said lower end of said rotor housing;

a tang and O-ring positioned on said upper end of said rotor housing, wherein said tang is concentric with respect to said central shaft;

a rotor positionable within said rotor housing, wherein said rotor includes a plurality of vane slots, wherein said rotor includes a bore hole, wherein said rotor includes a bearing, wherein said rotor includes a first end groove at its upper end and a second end groove at its lower end;

a machined groove positioned within said bore hole;

a plurality of rotor vanes, wherein each of said rotor vanes are positioned within each of said plurality of vane slots, wherein each of said rotor vanes includes a first extension and a second extension, wherein each of said first extensions and said second extension are slidably positioned within said groove of said interior surface of said rotor housing;

a galley positioned adjacent an inner end of each of said rotor vanes, wherein said galley is linked to said machined groove by one or more apertures;

a wear member positioned on an outer end of each of said rotor vanes, wherein said wear member is comprised of a wearable material;

a housing cover, wherein said housing cover includes an upper end and a lower end, wherein said lower end of said housing cover includes an inner groove and an outer groove, wherein each of said second extensions are slidably positioned within said inner groove, wherein said tang is sealably engaged with said outer groove, wherein said inner groove is comprised of a cam shape;

a notch formed on said lower end of said housing cover, wherein said notch is fluidly connected with said inner groove; and a shaft extending from said housing cover, wherein said shaft is adapted to be inserted within said bore hole;

wherein oil circulates through said notch, said inner groove, said first rotor end groove, said second rotor end groove, said galley, said apertures and said machined groove to said bearing.

* * * * *